US009474390B1

(12) United States Patent
Douvier

(10) Patent No.: US 9,474,390 B1
(45) Date of Patent: Oct. 25, 2016

(54) NON-LINEAR SLATWALL DISPLAYS

(71) Applicant: Robin J. Douvier, St. Cloud, MN (US)

(72) Inventor: Robin J. Douvier, St. Cloud, MN (US)

( * ) Notice: Subject to any disclaimer, the term of this patent is extended or adjusted under 35 U.S.C. 154(b) by 0 days.

(21) Appl. No.: 14/485,697

(22) Filed: Sep. 13, 2014

Related U.S. Application Data

(63) Continuation-in-part of application No. 14/331,514, filed on Jul. 15, 2014, now abandoned.

(60) Provisional application No. 61/846,599, filed on Jul. 15, 2013.

(51) Int. Cl.

| | |
|---|---|
| ***A47F 5/04*** | (2006.01) |
| ***A47F 3/00*** | (2006.01) |
| ***A47F 7/00*** | (2006.01) |
| ***A47F 5/00*** | (2006.01) |

(52) U.S. Cl.
CPC ..... *A47F 7/0007* (2013.01); *A47F 3/001* (2013.01); *A47F 5/00* (2013.01)

(58) Field of Classification Search
CPC ..... A47F 3/001; A47F 5/00; A47F 7/0007
USPC ..... 211/54.1, 57.1, 59.1, 94.01, 94.02; 52/36.4
See application file for complete search history.

(56) References Cited

U.S. PATENT DOCUMENTS

| | | | | |
|---|---|---|---|---|
| 3,739,919 | A | 6/1973 | Hochman | |
| 4,607,753 | A * | 8/1986 | Radek | A47F 5/0846 211/189 |
| 4,718,561 | A | 1/1988 | Eckert | |
| 4,747,025 | A | 5/1988 | Barton | |
| 4,936,472 | A * | 6/1990 | Meier | F16B 5/00 211/194 |
| 5,222,799 | A | 6/1993 | Sears et al. | |
| 5,347,434 | A | 9/1994 | Drake | |
| 5,390,462 | A * | 2/1995 | Kreiter | A47F 5/0846 211/189 |
| 5,431,761 | A | 7/1995 | Holztrager | |
| 5,485,934 | A | 1/1996 | Holztrager | |
| 5,635,674 | A | 6/1997 | Owen | |
| 5,653,348 | A * | 8/1997 | MacDonald | A47F 5/0807 211/87.01 |
| 5,655,674 | A | 8/1997 | Holztrager | |
| 5,678,373 | A | 10/1997 | Franklin et al. | |
| D397,561 | S | 9/1998 | Depottey et al. | |
| 5,921,044 | A | 7/1999 | Holztrager | |
| 5,983,574 | A | 11/1999 | Holztrager | |
| 6,068,135 | A | 5/2000 | Holztrager | |
| 6,199,705 | B1 | 3/2001 | Portner | |
| 6,283,278 | B1 | 9/2001 | Holztrager | |
| 7,093,726 | B1 | 8/2006 | Holztrager | |
| 7,104,023 | B1 | 9/2006 | Holztrager | |
| 8,602,227 | B1 | 12/2013 | McDonald | |
| 2007/0090067 | A1 | 4/2007 | Holztrager | |
| 2008/0000861 | A1 | 1/2008 | Muellerleile | |

* cited by examiner

*Primary Examiner* — Joshua Rodden
(74) *Attorney, Agent, or Firm* — Albert W. Watkins

(57) ABSTRACT

A merchandise display support that can be adjusted to accommodate and showcase a wide variety of merchandise has a base and a hollow slatwall tower rising from the base that is fabricated from a plurality of individual layers. The individual layers may be of any suitable geometry, including waves, curves and other artistic shapes. Each layer is produced individually and defines an outer periphery of material preferably surrounding a hollow interior. The layers are stacked and secured to adjacent layers to create slatwall grooves that yields a three-dimensional slatwall display rack that can take nearly any contour or geometry. Illumination sources may be provided within the slatwall grooves and are protected by the geometry of the grooves from contact or interference with slatwall merchandising hooks and are not directly visible to a customer. The tower top may also have lights to illuminate the merchandise.

10 Claims, 7 Drawing Sheets

NON-LINEAR SLATWALL DISPLAYS

CROSS REFERENCE TO RELATED APPLICATIONS

This application is a Continuation-In-Part of co-pending U.S. patent application Ser. No. 14/331,514 filed Jul. 15, 2014 of like title and inventorship, and claims the benefit under 35 USC 119(e) of provisional application Ser. No. 61/846,599 filed Jul. 15, 2013, the entire contents of each which are incorporated herein by reference.

BACKGROUND OF THE INVENTION

1. Field of the Invention

This invention pertains generally to supports, and more specifically to a non-linear display wall, column, divider or the sort having racks specially mounted in at least one trackway to support merchandise.

2. Description of the Related Art

Proper showcasing or staging of merchandise has long been known by merchants to be vital to optimal sales. As but one example, jewelry has long been sold from specially illuminated display cases that provide a rich spectrum of light, such that diamonds and other jewelry will sparkle to the fullest extent possible. Quite literally, the jewelry is placed in the best light possible.

While full spectrum illumination is particularly effective for jewelry sales, other merchandise requires different staging or display, and may be of very diverse dimension. As may be apparent, there is much and widely varied merchandise, so much so that no one display will optimally serve all different types of merchandise. As a result, various artisans have designed many product specific display racks. As but one example of these displays is U.S. Pat. No. 4,718,561 by Eckert, entitled "Eyeglass frame display", the teachings and contents which are incorporated herein by reference.

In addition to the different types and sizes of merchandise, each requiring different optimal presentations, retailers face other challenges. While particular merchandise may be optimally displayed in a particular way, the retailer will also preferably maintain brand or store consistency of appearance and handling, since this consistency facilitates store management, reduces the extent of training overhead, and creates a consistent atmosphere or feel for the customers.

The desire to display each product in the best manner for that product contrasts with the desire to maintain brand or store consistency. Consequently, various artisans have sought to develop merchandise supports that can be easily customized by a merchant to fit diverse merchandise, while still preserving a common look or feel. One type of approach has been the use of a perforate support and a plurality of bent pegs the pegs which are designed to be moved to an appropriate hole for a particular product to be displayed. Exemplary US patents, the teachings and contents of each which are incorporated herein by reference, include: U.S. Pat. No. 3,739,919 by Hochman, entitled "Display device apertured for holding support hooks"; and U.S. Pat. No. 5,653,348 by MacDonald, entitled "Arcuate peg board". Unfortunately, these pegs offer very little stability when placed in the hole, relying entirely upon the load upon the peg to hold the peg against the support. When a customer or other passer-by inadvertently bumps the peg, the peg may easily be dislodged or disrupted sufficiently to spill the merchandise suspended therefrom. Furthermore, the surface area adjacent to the support perforations is quite small, meaning there is a substantial load placed upon the structure surrounding the hole. If a customer leans or presses upon the exposed end of the peg, the distal end passing through the perforate hole may tear or bend the support due to the great force applied thereto.

Another technique for displaying diverse merchandise is the use of a slatwall. These walls consist of a generally planar surface having a plurality of parallel, typically horizontal grooves formed therein. Special hooks may be inserted into adjacent pairs of grooves, and these hooks have much larger engagement with the wall than typical prior art peg boards or perforate panels. Exemplary US patents and published patent applications, the teachings and contents of each which are incorporated herein by reference, include: U.S. Pat. No. 5,431,761 by Holztrager, entitled "Method of manufacturing an exhibit panel"; U.S. Pat. No. 5,655,674 by Holztrager, entitled "Exhibit panel with lightweight hollow backboard"; U.S. Pat. No. 5,921,044 by Holztrager, entitled "Display wall assembly and method of making same"; U.S. Pat. No. 5,983,574 by Holztrager, entitled "Merchandise display panel"; U.S. Pat. No. 6,068,135 by Holztrager, entitled "Merchandise display panel with lockable display card"; U.S. Pat. No. 6,283,278 by Holztrager, entitled "Merchandise display panel with lockable display card"; U.S. Pat. No. 7,104,023 by Holztrager, entitled "Wall organizer"; U.S. Pat. No. 8,602,227 by McDonald, entitled "Slatwall panel"; 2007/0090067 by Holztrager, entitled "Lattice merchandise display system"; and 2008/0000861 by Holztrager, entitled "Slatwall adapter". Flat displays are limited in area by the amount of wall space available for the display. Furthermore, they are very restricted in creating aesthetic appeal, owing to the undesirable limitation of being generally planar. They are, nonetheless, generally an improvement over the perforate walls of the prior art.

A few artisans have enhanced the appearance of these planar slatwalls through the use of creative illumination. Exemplary US patents, the teachings and contents of each which are incorporated herein by reference, include: U.S. Pat. No. 4,747,025 by Barton, entitled "Low voltage lighting fixture with track electrodes"; and U.S. Pat. No. 6,199,705 by Portner, entitled "Lighting fixture display". Unfortunately, these techniques require large and obtrusive lighting structures, detracting from the merchandise and potentially creating an electrical safety hazard with customers.

A few artisans have also constructed free-standing and three-dimensional displays from slatwall. Exemplary US patents, the teachings and contents of each which are incorporated herein by reference, include: U.S. Pat. No. 5,485,934 by Holztrager, entitled "Merchandise display assembly"; and Des U.S. Pat. No. 397,561 by DePottey et al, entitled "Freestanding modular display/divider wall". These displays use a plurality of flat sheets of slatwall that have been coupled with adjacent, non-parallel slatwall to produce a three-dimensional shape having more artistic and utilitarian purpose than the entirely planar slatwall. Nevertheless, these remain quite limited in the shapes that may be produced, not having the capability for any curved surfaces, and the merchandise displays produced therefrom are undesirably "blocky" in appearance.

One particularly creative slatwall display is illustrated in U.S. Pat. No. 7,093,726 by Holztrager, entitled "Curved display shelf", the teachings and contents of each which are incorporated herein by reference. In this patent, slatwall is fabricated from an extruded polyvinylchloride sheet that is heated and pressed against a mold to form the sheet into an arcuate shape such as the semicircle illustrated therein. This allows an artistic and curved shelf to be suspended from an otherwise planar slatwall, providing both dimension and non-planar geometry. Unfortunately, and in part owing to the manufacturing technique, this display shelf is very limited in the loading from displayed merchandise or customers, and so is quite limited in size. Furthermore, this display shelf must be supported upon a standard planar slatwall, still undesirably restricting the geometries of merchandise displays made therefrom.

Several additional US patents of less direct relevance illustrate technology from which the teachings and content which are incorporated herein by reference, including: U.S. Pat. No. 5,222,799 by Sears et al, entitled "Stair lights"; U.S. Pat. No. 5,347,434 by Drake, entitled "Aircraft bag-rack with an illuminated handrail"; U.S. Pat. No. 5,635,674 by Owen, entitled "Sealed passage for electrical leads across a barrier"; and U.S. Pat. No. 5,678,373 by Franklin et al, entitled "Modular precast wall system with mortar joints". In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a non-linear slatwall merchandising display. A base and a plurality of vertically stacked layers define a tower. At least two adjacent ones of the plurality of vertically stacked layers have a slatwall groove cut into a bottom surface and a slatwall notch cut into a top surface. The combination of adjacent slatwall groove and slatwall notch formed by adjacent vertically stacked layers forms a merchandising hook receiving slat.

OBJECTS OF THE INVENTION

Exemplary embodiments of the present invention solve inadequacies of the prior art by providing a hollow slatwall tower fabricated from a plurality of individual layers. The individual layers may be of any suitable geometry, including waves, curves and other artistic shapes. Each layer is produced individually and defines an outer periphery of material surrounding a hollow interior. The layers are then stacked and secured to adjacent layers to create slatwall grooves, and yielding a three-dimensional slatwall display rack that can take nearly any contour or geometry. Lights may be provided within the slatwall grooves.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a merchandise display support that can be adjusted to accommodate and showcase a wide variety of merchandise. A second object of the invention is to provide an artistic and aesthetically pleasing merchandise display support that may be fabricated from a wide variety of shapes and geometries. Another object of the present invention is to enable illumination within slatwall grooves that is not directly visible to a customer. A further object of the invention is to protect the illumination sources from contact or interference with slatwall merchandising hooks.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

Figure 1:
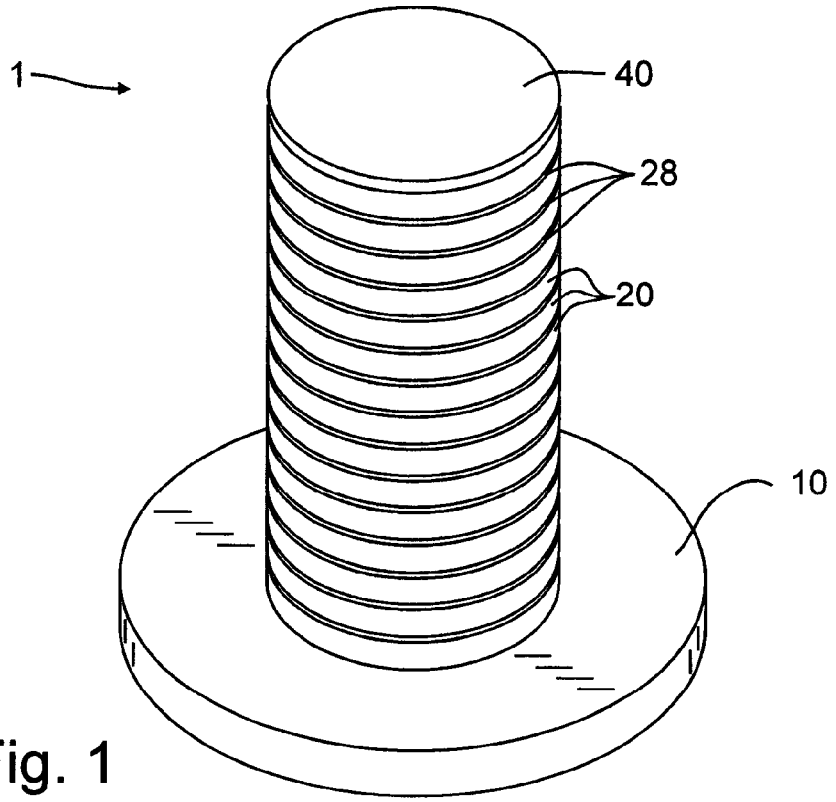
FIG. 1 illustrates a preferred embodiment non-linear slatwall display designed in accord with the teachings of the present invention from a projected view.
Figure 2:
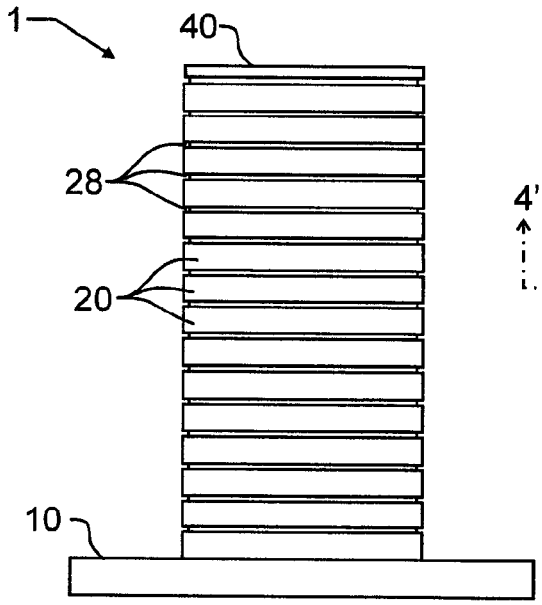
FIG. 2 illustrates the preferred embodiment non-linear slatwall display from a side elevational view.
Figure 3:
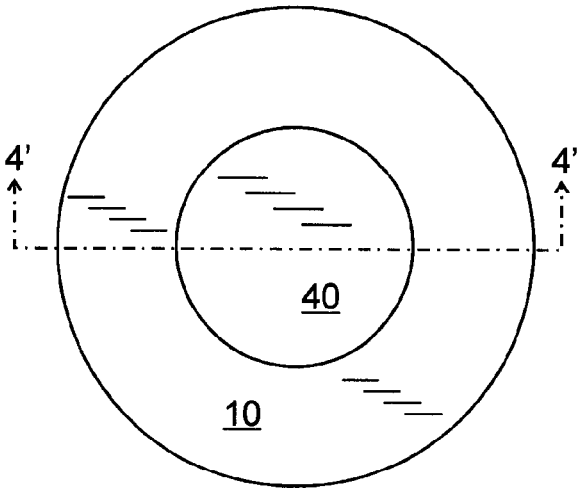
FIG. 3 illustrates the preferred embodiment non-linear slatwall display from a top plan view.
Figure 4:
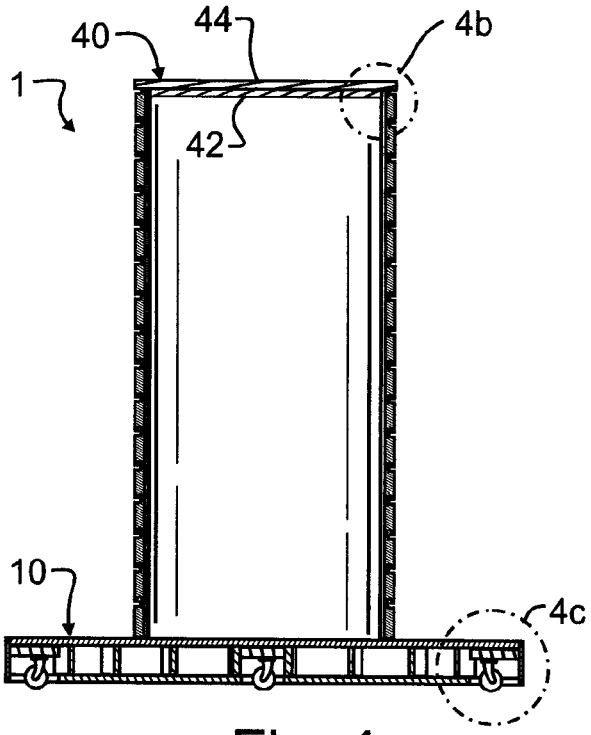
FIG. 4 illustrates the preferred embodiment non-linear slatwall display from a side elevational and sectional view taken along section line 4' of FIG. 3 to illustrate the construction in greater detail.

FIG. **4*b* is an enlarged portion taken from FIG. 4 at the region defined by section line 4*b*** to illustrate the layering and assembly in greater detail.

FIG. **4*c* is an enlarged portion taken from FIG. 4 at the region defined by section line 4*c*** to illustrate the castor wheel design in greater detail.

Figure 5:
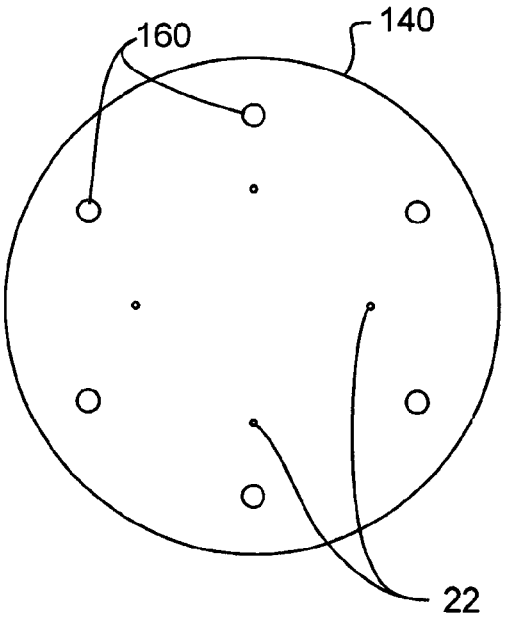

FIG. 5 illustrates an alternate embodiment display cover with lights from a bottom plan view.

Figure 6:
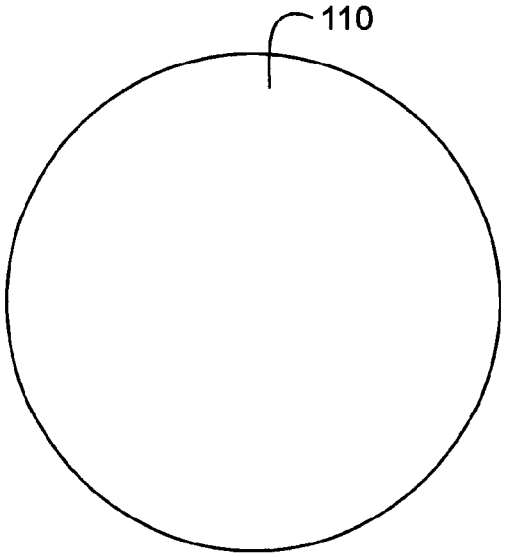

FIG. 6 illustrates an alternate embodiment display base from a top projected view.

Figure 7:
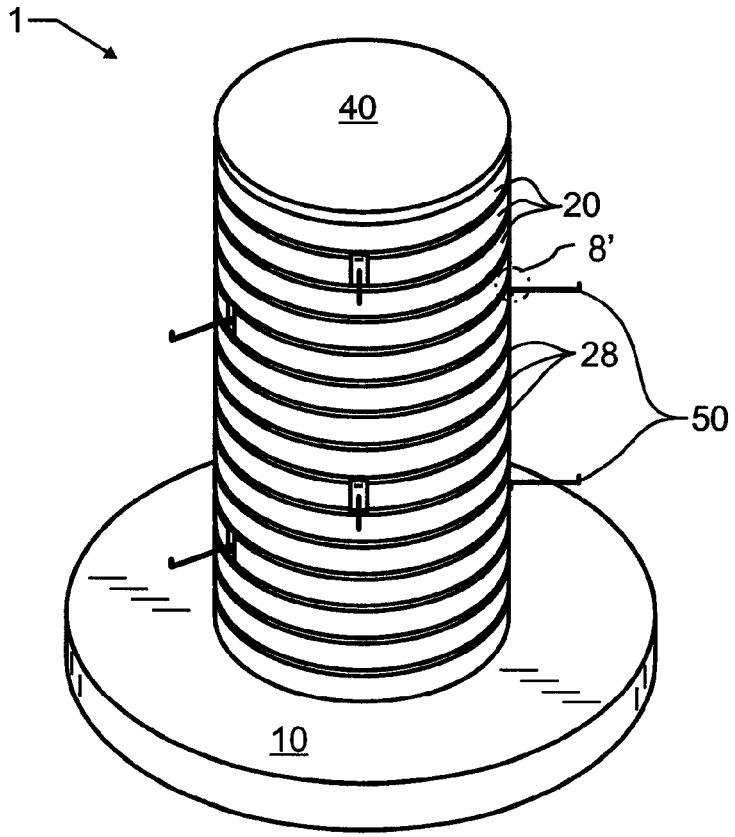

FIG. 7 illustrates the preferred embodiment non-linear slatwall display from a perspective view to illustrate merchandising hook capabilities.

Figure 8:
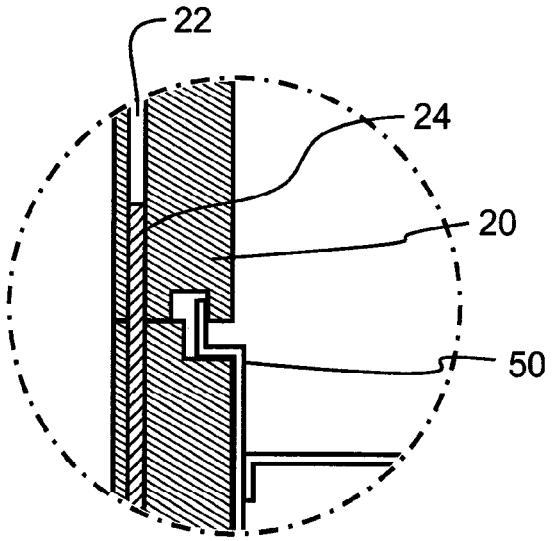

FIG. 8 illustrates the preferred embodiment non-linear slatwall display from a close-up side elevational and sectional view to illustrate the merchandising hook connection in greater detail.

Figure 9:
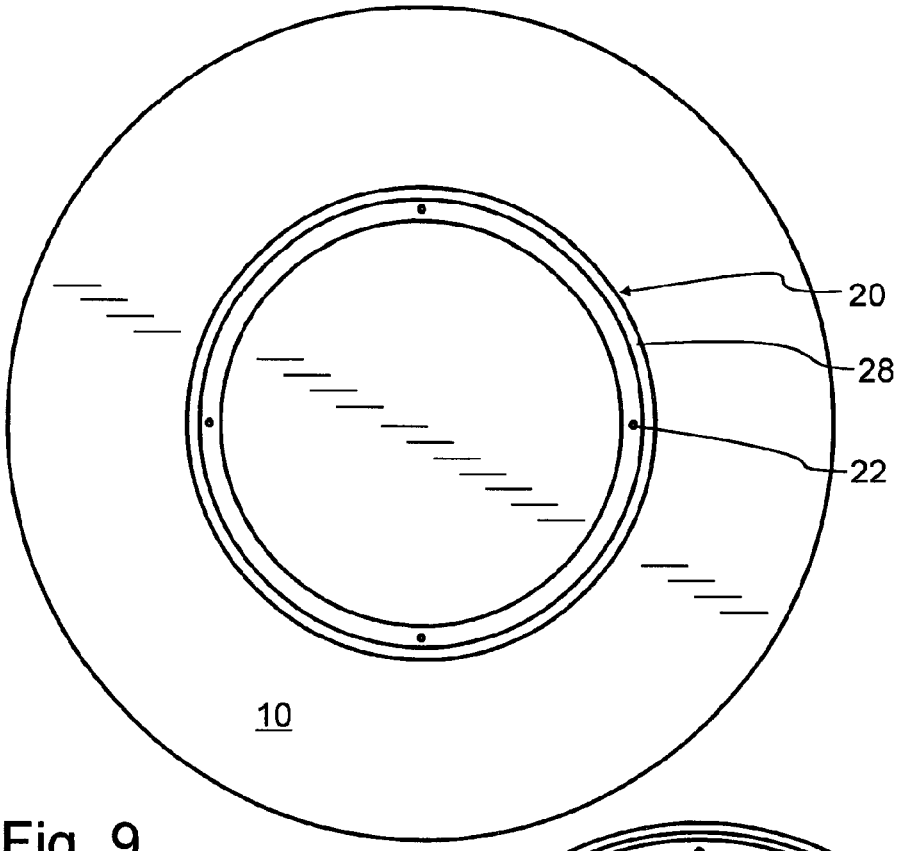

FIG. 9 illustrates the preferred embodiment non-linear slatwall display from a top plan view and with the top cover removed.

Figure 10:
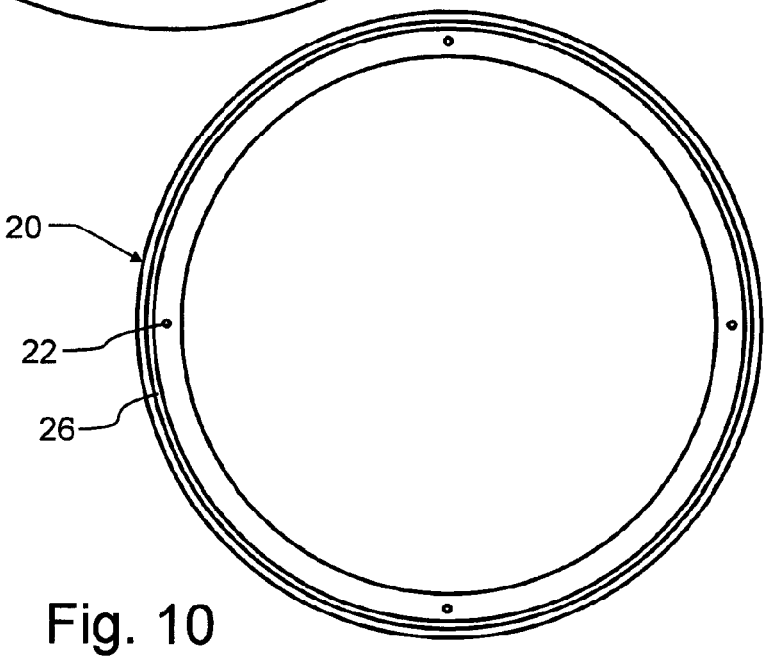

FIG. 10 illustrates a single tower layer used in the preferred embodiment non-linear slatwall display from a bottom plan view.

Figure 11:
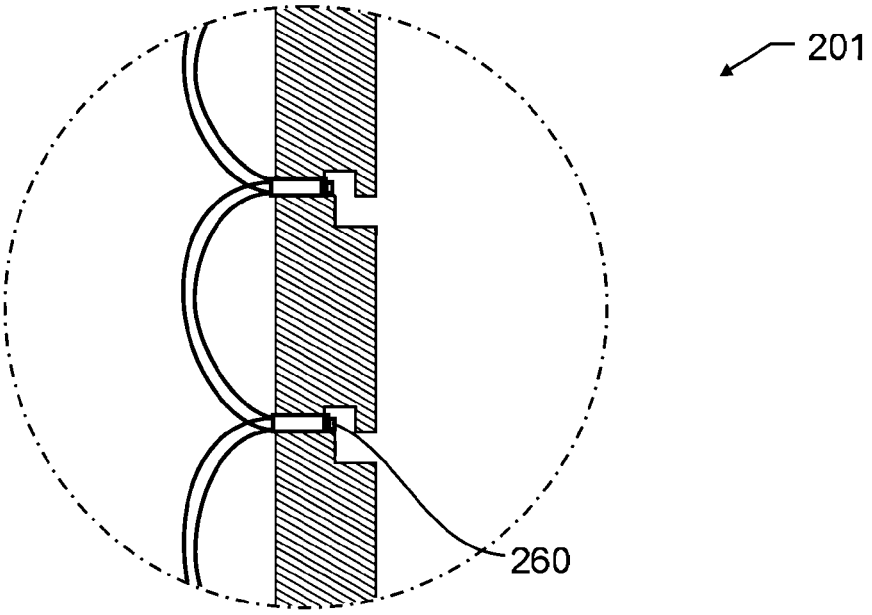

FIG. 11 illustrates an alternate embodiment non-linear slatwall display from a close-up side elevational and sectional view similar to that of FIG. 8, to illustrate internal illumination capabilities.

Figure 12:
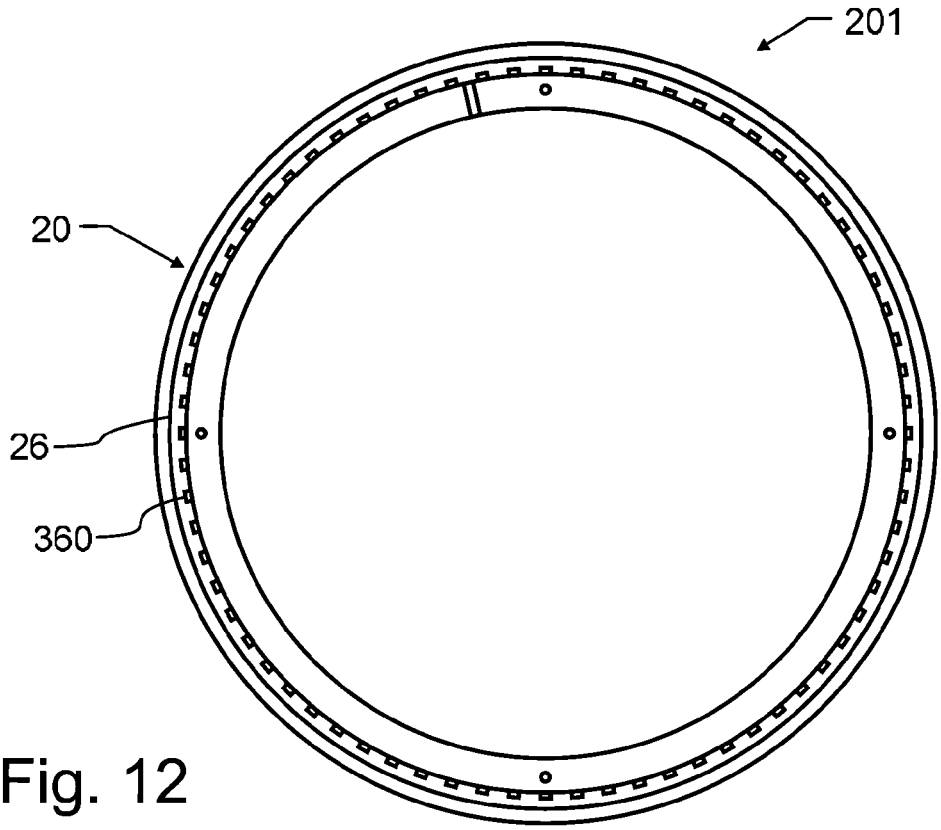

FIG. 12 illustrates an alternate embodiment non-linear slatwall display from a bottom plan view to illustrate placement of illumination sources.

Figure 13:
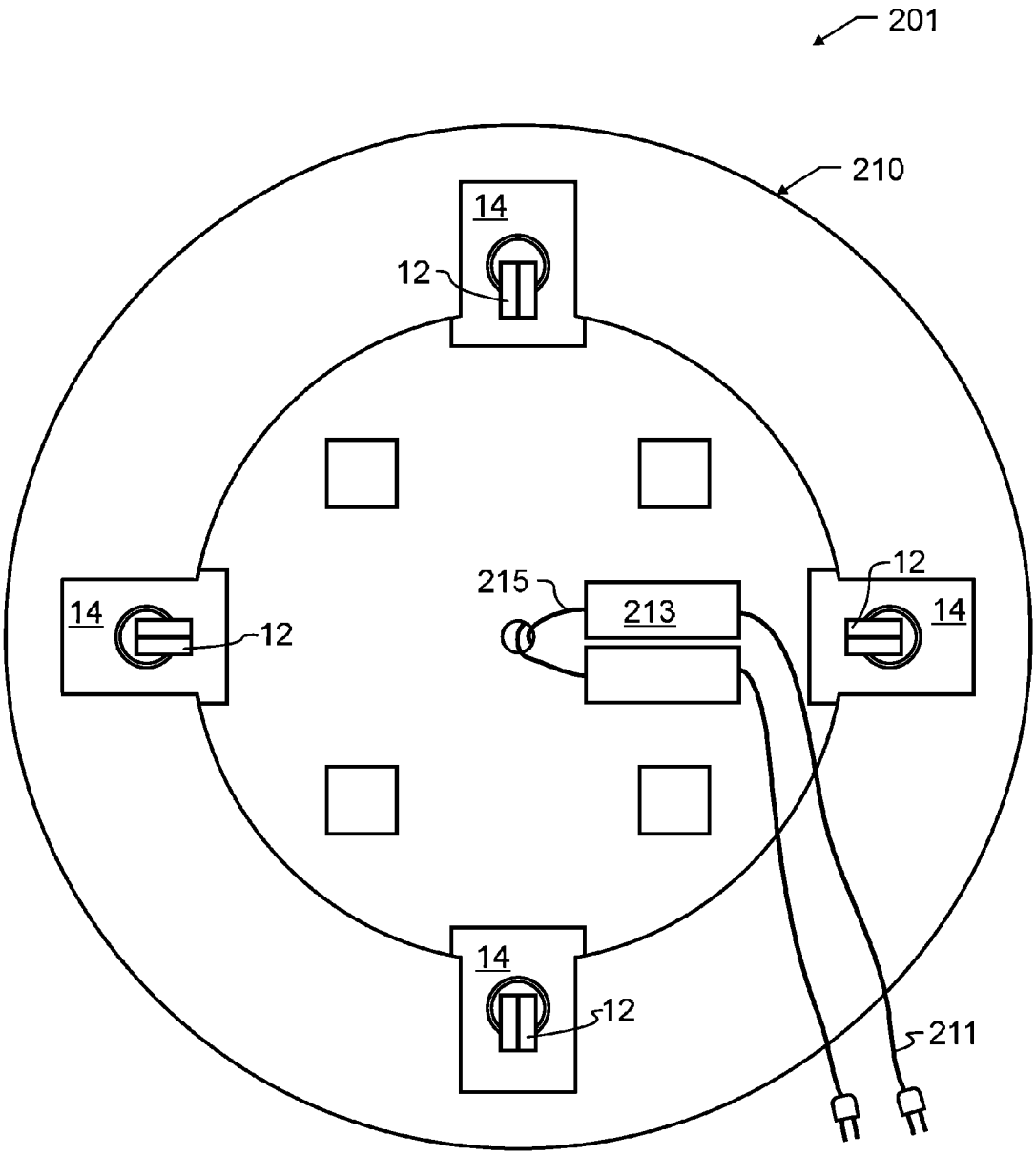

FIG. 13 illustrates an alternate embodiment base from a bottom plan view.

DESCRIPTION OF THE PREFERRED EMBODIMENT

Designed in accord with the teachings of the present invention, and illustrated in FIGS. 1-4 and 7-10, a first preferred embodiment non-linear slatwall display 1 is comprised of a circular base 10, a plurality of layers 20 stacked together to form a tower, and a tower cover 40. As can be seen in FIGS. 1-4, the base is preferably wider than the tower layers and the top, adding stability to the structure. The base 10 and layers 20 are illustrated as being generally circular or cylindrical, but as will be described herein below, the present invention is not so limited, and these may comprise an unlimited array of shapes and geometries.

As can be seen in FIGS. 10 and 11, each tower layer 20 is preferably circular with a hollow center. This forms a hollow core within preferred embodiment non-linear slatwall display 1 and thereby makes the structure more lightweight, saves on material expenses, and permits components or storage within the core of non-linear slatwall display 1 as will be described in greater detail herein below. The tower layers 20 are preferably designed with pinholes 22 equidistance from each other around the layer. Alignment pins 24 can be inserted into these pinholes. Preferably, when stacked, half of each alignment pin is in one layer and the other half of the alignment pin is in the adjacent layer, such as is visible in FIG. 4*b*. This ensures layers 20 are positioned properly and will not slide laterally or rotate. While pinholes 22 and alignment pins 24 are preferred, it will be understood that any other suitable method of indexing and alignment as known and taught in the mechanical arts may be incorporated herein.

Figure 4B:
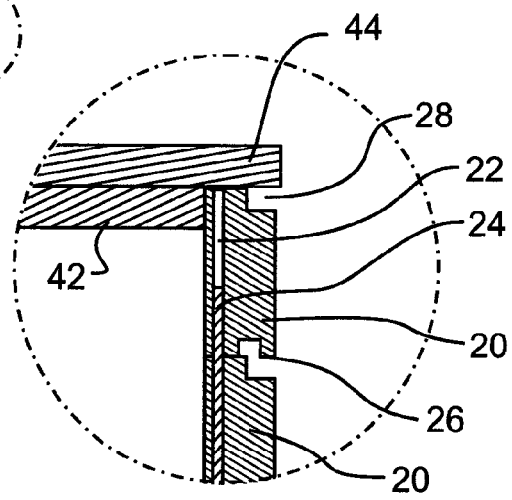

Each tower layer 20 preferably has a dado or other groove, herein identified as a slatwall groove 26, cut into the bottom to accommodate the tips of merchandising hooks 50 and lighting 260, and in the top of tower layer 20, the upper edge is preferably rabbeted or otherwise indented to form a slatwall notch 28 to accommodate the insertion of merchandising hooks 50, as can be seen in FIGS. 4*b*, 7, and 8. In the preferred embodiment non-linear slatwall display 1, the diameter of the inner wall of slatwall groove 26 is smaller than the outer diameter of slatwall notch 28, as illustrated in FIG. 4*b*. This means that the inner wall surface of slatwall groove is indented or recessed slightly more than slatwall notch 28. This slight recess permits LED lighting 260, described in detail herein below in an alternative embodiment, to be placed in this recessed space provided by slatwall groove 26 immediately adjacent to slatwall notch 28, and slatwall notch 28 will guide slatwall merchandising hooks 50 over and entirely out of contact with LED lighting 260.

Each tower layer 20 can be designed to be any height, but layers around three inches are preferred in order to accommodate the height of merchandising hooks and also to maximize the number of layers 20 in a given tower height. Tower layers 20 can preferably be stacked in any number, allowing towers to be of varying heights to accommodate different uses.

Alternatively, tower layers 20 can be of any size or shape that allows for a stable structure, such as but not limited to an oblong shape or any other object. Layers 20 may also vary in size relative to each other, as long as pinholes 22 line up between adjacent layers and the center of mass remains reasonably centered. This means that nearly any non-linear shape for preferred embodiment non-linear slatwall display 1 may be fabricated and assembled in accord with the teachings of the present invention.

As can be seen in FIG. 4*b*, tower top 40 is preferably formed of two concurrent, attached, short disks with one smaller than the other is. The smaller disk 42 is preferably equal in diameter to the hollow center of tower layers 20, allowing disk 42 to fit inside the topmost tower layer 20. The larger disk 44 is preferably equal in diameter to the outer edge of tower layers 20, allowing it to sit on top of layer 20. This creates a cover to keep the internal space enclosed and clean, while providing a more polished appearance.

Alternatively, the tower top 40 may be formed from a single piece of material with a groove cut out of the edge to mimic the shape of two concurrent cylinders, or the top may be a single disk with pinholes 22 to secure the top to the tower layers 20.

Figure 4C:
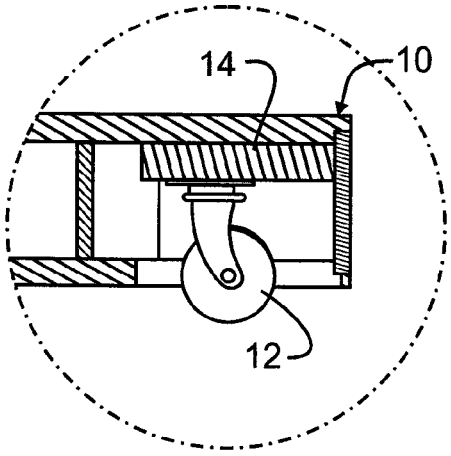

Optionally, base 10 may contain castor wheels 12 for easier transportation as illustrated in FIGS. 4*c* and 13. These wheels 12 are preferably secured to a reinforcing plate 14 on the underside of base 10, and recessed so that base 10 is still very close to the ground. This improves visual appeal, stability, and helps prevent objects from accidentally going underneath base 10.

Base 10, tower layers 20, and tower top 40 may be made of many materials, such as but not limited to Medium Density Fiber (MDF) board that may be laminated using High Pressure Laminate or hardwood veneers, or may be painted or shrink wrapped decoratively, for exemplary purposes. In but one of many alternatives, these components may be rotationally or otherwise molded. Any combination of materials that provides the requisite structural strength can be used for the different components.

Various embodiments of non-linear slatwall displays designed in accord with the present invention have been illustrated in the various figures. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

An alternative embodiment may be seen in FIGS. 5 and 6. In this alternative embodiment, top 140 is the same diameter as base 110, which, like base 10, is larger in diameter than layers 20. This means that top 140 protrudes beyond tower layers 20. In the space between the outer diameter of layers 20 and the outer diameter of top 140, lights 160 are preferably installed. These lights 160 preferably illuminate tower layers 20 and any attached objects, such as merchandising hooks 50 and merchandise.

FIG. 7 illustrates one exemplary placement of merchandising hooks 50 into slatwall grooves 26 and notches 28, though it will be apparent that these merchandising hooks 50 may be placed anywhere across the surface of layers 20, allowing tremendous flexibility in the placement and display of merchandise.

FIG. 8 illustrates the top portion of merchandising hook 50 within slatwall groove 26 and notch 28. The recess formed by the inner wall surface of slatwall groove 26 immediately adjacent to slatwall notch 28 permits merchandising hook 50 to be tilted slightly to facilitate insertion into slatwall groove 26.

FIG. 9 illustrates the preferred embodiment non-linear slatwall display 1 from a top plan view and with the top cover removed. Slatwall notch 28 is clearly visible therein, as are the pinholes 22. In FIG. 10, a single tower layer is shown from a bottom view to illustrate the placement of slatwall groove 26 and pinholes 22.

Alternative embodiment non-linear slatwall display 201 is illustrated in FIGS. 11-13. In this embodiment, LED lighting 260 is preferably installed to illuminate slatwall grooves 26. The outer diameter wall of slatwall grooves 26 blocks any direct illumination from LED lighting 260, but indirect lighting therefrom highly illuminates slatwall notches 28. This gives the visual impression of a plurality of light rings within non-linear slatwall display 201, the color of which may be varied using suitably colored lights. The number and type of lights may vary to meet the needs of a particular application. Examples of alternative lighting means include rope lighting, strip or LED tape lighting 360 illustrated in FIG. 12, or other various types of bulbs, and the light may be of any color or combination thereof.

Alternative embodiment base 210 preferably contains an LED power supply 213 on the underside, coupled to line power through cord 211 and to the lights 260 through wiring 215, as illustrated in FIG. 14. This location may vary, as long as the user can retain access after the entire unit is constructed and assembled.

Other light installations are contemplated herein, such as lights installed in base 10 to illuminate the floor, merchandise, or other objects.

Other modifications contemplated herein in various alternative embodiments may be provided or made to the preferred embodiment. For example, the height of base 10 may be expanded and a door installed to access the interior of the base, providing a storage space. This storage space could be used for many purposes, such as but limited to storing and/or locking merchandise or merchandising hooks. A door could also provide access to the interior of the tower.

In addition, a battery may be provided in the storage space or otherwise associated with base 10 to provide power to lights 160, LED lighting 260 or LED light strips 360 without requiring continuous connection to an outlet. This permits non-linear slatwall display 1 to be rolled about a store and illuminated, without requiring a pre-located outlet, and without creating a trip hazard from a power cord. The use of fluorescent or LED lights generally provides sufficient efficiency to permit extended operation from a battery such as a lead-acid gel cell or lithium battery, as is known generally in the electrical and chemical arts.

Where desired or appropriate, preferred embodiment non-linear slatwall display 1 may further be provided with a photovoltaic panel on top of tower top 40 or at any other suitable location. A photovoltaic panel uniquely permits preferred embodiment non-linear slatwall display 1 to be rolled about a store to any location that will be sufficiently illuminated to provide adequate power to either continuously, intermittently, or after dark enable lights 160, LED lighting 260 or LED light strips 360 to be illuminated. For exemplary purposes, a store light may shine down upon a store floor area with sufficient power to enable LED lighting 260 to be energized without a direct coupling through cord 211 to line power. Similarly, a photovoltaic panel may be used to charge a battery during daylight, and then the battery may be used to create novel lighting in the evening hours after the sun has set.

From the foregoing figures and description, several additional features and options become more apparent. First of all, non-linear slatwall displays designed in accord with the teachings of the present invention may be manufactured from a variety of materials, including metals, resins and plastics, ceramics or cementitious materials, or even laminates, combinations or composites of the above. The specific material used may vary, though special benefits are attainable if several important factors are taken into consideration. First, the material will preferably be stable, durable, and provide a quality retail appearance. Furthermore, it is preferable that all materials are sufficiently tough and durable to not fracture, even when great forces are applied thereto. Desirably, the materials may be colored and resist corrosion.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A non-linear slatwall merchandising display, comprising:

a base; and a plurality of vertically stacked layers defining a tower;

a first one of said plurality of vertically stacked layers having a bottom surface extending generally horizontally, an exterior vertical face extending generally vertically, and a slatwall groove formed into said bottom surface and displaced from said exterior vertical face; and a second one of said plurality of vertically stacked layers adjacent to said first one of said plurality of vertically stacked layers and having a top surface extending generally horizontally and an exterior vertical surface extending generally vertically and a slatwall notch formed into both of said exterior vertical surface and said top surface, said slatwall notch adjacent to said slatwall groove partially overlapping and in communication with a generally exterior portion of said slatwall groove and thereby forming a merchandising hook receiving slat while said top surface also partially overlaps said slatwall groove and thereby blocks direct vertical access to a generally interior portion of said slatwall groove.

2. The non-linear slatwall merchandising display of claim 1, wherein said first and second ones of said plurality of vertically stacked layers are generally annular, and wherein an outside diameter at said slatwall notch is larger than an inside diameter of said slatwall groove.

3. The non-linear slatwall merchandising display of claim 2, further comprising a light source placed in said generally interior portion of said slatwall groove immediately adjacent to said top surface, wherein said slatwall notch and said top surface are adapted to operatively guide a slatwall merchandising hook over and out of contact with said light source.

4. The non-linear slatwall merchandising display of claim 1, further comprising a hollow center within each individual one of said plurality of vertically stacked layers.

5. The non-linear slatwall merchandising display of claim 1, wherein said first and second ones of said plurality of vertically stacked layers further comprises a plurality of generally vertically aligned pinholes configured to receive alignment pins passing between and operatively securing said first and second ones of said plurality of vertically stacked layers together.

6. The non-linear slatwall merchandising display of claim 1, wherein each individual one of said plurality of vertically stacked layers is identical in construction and geometry to others of said plurality of vertically stacked layers.

7. A non-linear slatwall merchandising display, comprising:

a base; and a plurality of vertically stacked annular layers defining a tower, each individual one of said plurality of vertically stacked annular layers having a bottom surface extending generally horizontally, an exterior vertical face extending generally vertically from said bottom surface, a top surface extending generally horizontally, a generally annular slatwall notch having an inside diameter circumscribing said top surface and an outside diameter defining a top of said exterior vertical face at an elevation below said top surface, and a generally annular slatwall groove formed solely in said bottom surface and thereby displaced from said exterior vertical face, said generally annular slatwall groove having an outside diameter intermediate between said generally annular slatwall notch inside diameter and said generally annular slatwall notch outside diameter, and said generally annular slatwall groove having an inside diameter less than said generally annular slatwall notch inside diameter.

8. The non-linear slatwall merchandising display of claim 7, further comprising a light source placed within at least one of the generally annular slatwall grooves immediately adjacent to said generally annular slatwall groove inside diameter and immediately adjacent to said bottom surface.

9. The non-linear slatwall merchandising display of claim 7, further comprising at least one generally vertically aligned pin passing between at least one of the bottom surfaces and at least one of the top surfaces immediately adjacent to said at least one of the bottom surfaces.

10. The non-linear slatwall merchandising display of claim 7, wherein each individual one of said plurality of vertically stacked annular layers is identical in construction and geometry to others of said plurality of vertically stacked annular layers.

* * * * *